United States Patent [19]

Kamper

[11] 4,074,854

[45] Feb. 21, 1978

[54] HEATING APPARATUS

[75] Inventor: Egbert B. Kamper, Rudyard, Mich.

[73] Assignee: Kamper's Woodfire Co., Inc., Rudyard, Mich.

[21] Appl. No.: 700,687

[22] Filed: June 28, 1976

[51] Int. Cl.[2] ..... F24D 5/04

[52] U.S. Cl. ..... 236/11; 126/110 R; 110/173 R

[58] Field of Search ..... 126/61, 63, 66, 67, 126/70, 77, 110 R, 190, 194; 236/11; 49/68; 110/173 R

[56] References Cited

U.S. PATENT DOCUMENTS

| | | | |
|---|---|---|---|
| 304,330 | 9/1884 | Lakin | 236/11 X |
| 1,138,854 | 5/1915 | Edgecombe, Jr. | 236/11 X |
| 1,569,220 | 1/1926 | Downe | 110/173 R |
| 1,813,132 | 7/1931 | Freeman | 236/11 |
| 1,989,278 | 1/1935 | Jones | 236/11 |
| 2,039,948 | 5/1936 | Best | 236/11 |
| 2,170,232 | 8/1939 | Bower | 236/11 |
| 2,810,380 | 10/1957 | Critten | 126/61 X |

*Primary Examiner*—William E. Wayner
*Assistant Examiner*—William E. Tapolcai, Jr.
*Attorney, Agent, or Firm*—McGarry & Waters

[57] ABSTRACT

A heating apparatus has a firebox, ash pit and flue enclosed in a casing wherein the fire is maintained toward the rear of the firebox and the ash pit is positioned at the front and below the firebox. The flue connects to a rear portion of the firebox and extends toward the front of the casing and then rearwardly where the fumes are exhausted to the atmosphere. Electrical controls adjustably open a vent located in the front of the ash pit to control the size of the fire by controlling the available oxygen. A fan mechanism circulates fresh air around the firebox and the flue inside the casing to provide a source of heated air for convection heating. The fan is controlled by a temperature controller to maintain the heated air within specified temperature limits.

8 Claims, 6 Drawing Figures

HEATING APPARATUS

BACKGROUND OF THE INVENTION

1. Field of the Invention

This invention relates to a solid fuel burning heater for use with homes, cabins and other interiors.

2. Description of the Prior Art

Wood-burning stoves and heaters have been used for many years. Although the use of these stoves has waned considerably over the years, interest in these types of stoves has rekindled recently in view of feared shortages of hydrocarbon fuels and electrical energy. Such stoves have become more popular for second homes which are in isolated areas.

Conventionally such stoves have included a firebox which is loaded from the front and an ash pit beneath the firebox. Air is circulated around the firebox to provide heated air for convection heating. Typically, a grate is positioned above the ash pit so that a passage for circulated air exists from the ash pit to the firebox and ashes fall into the ash pit. Oxygen needed for combustion is vented through the ashpit, up through the grate, and fed to the fire with the gases of combustion rising above the fire to the flue.

One such apparatus is disclosed in the United States patent issued to Frederickson U.S. Pat. No. 1,144,117, issued June 22, 1915. The ash pit is located directly below the firebox. A grate is placed at the bottom of the firebox to hold the materials for combustion. The ash pit is provided with an air register which brings air through the ash pit, through the grate, and into the furnace body. The gases of combustion then rise through an upper box which provides a tortuous passage for the gases of combustion before the hot gases are exhausted through the flue.

This structure permits the fire to burn adjacent the firebox door so that smoke and even fire find escape through the firebox door when opened, thereby hindering addition of more fuel, causing inconvenience to the operator of the heater and smoking up the room.

A heater having a fan forcing air through the heater is disclosed in a United States patent issued to Pederson, U.S. Pat. No. 2,058,654, issued Oct. 20, 1936. This reference discloses an ash pit placed directly below the firebox with a grate separating the two. The fire is located directly above the grate. The oxygen comes through the ash pit up through the grate and feeds the fire. The gases of combustion then rise through a circular flue. The air to be heated is drawn by a fan located at the bottom of the heater which forces the air up through radiating fins.

Another heating device is disclosed in the Bowers, U.S. Pat. No. 610,795, issued Sept. 13, 1898. The Bowers reference discloses a stove which has the ash pit below the firebox with a grate separating the two. An oven which is used for baking is at the side of the ash pit and firebox. The heated air goes through pipes in a tortuous manner behind and over the oven and then through an upper section where the pipe picks up heat from the hot gases of combustion before the gases leave the upper section to the flue.

SUMMARY OF THE INVENTION

According to the invention, a heating apparatus is provided which has a firebox having a solid nonporous base in its rear portion and, preferably, an ash pit connected below and to the front of the firebox. A grate separates the ash pit from the front portion of the firebox. A flue is connected to the upper rear portion of the firebox. The flue extends forwardly to the front of the casing and back to the rear of the casing where is exits therethrough. At the front of the casing, an entrance door provides an access to the interior of the flue.

The operator's entrance to the firebox is a door in front of the firebox. The heating apparatus is enclosed in a casing in which space exists between at least one of the firebox walls and the casing and space also exists between the flue pipe and the casing. An air intake is located in a lower portion of the casing for supplying air to be heated. Preferably, a fan is adjacent the air intake inside the casing. A duct is located at an upper portion of the casing for the heated air to pass from the heater.

A vent is preferably below the firebox door for controlling the amount of oxygen to the firebox. Preferably, the vent includes a flap door operatively attached to a thermostatically controlled solenoid actuator. The solenoid actuator is preferably attached to the exterior of the casing above the vent flap door. The solenoid actuator is operatively coupled to an electrical potential such that when current goes through the solenoid coil, the actuating core of the solenoid is pulled upward. A coupling operatively connecting the flap door to the solenoid is preferably connected at one end to the solenoid core and at another end to a protrusion on the lower portion of the vent flap door. The upward pull of the solenoid core thereby pulls on the coupling to open the flap door. When current is not energizing the solenoid, the vent flap door is closed.

A thermostatic control switch operatively connected to the solenoid actuator is preferably placed somewhere remotely in the area to be heated. When the temperature is greater than a predetermined degree, the switch is open and prevents electrical current from going through the solenoid coil, thereby maintaining the vent flap door in a closed position. When the temperature is below a predetermined degree, the thermostatic switch is closed allowing current to go through the solenoid.

The heater has the oxygen for combustion drawn through the vent flap door, preferably up through the ash pit, and through the grate. The fuel is placed in the rear portion of the firebox on the solid nonporous base. The oxygen passes next to and over the fuel instead of passing through it. A slower, more efficient burning of fuel thus occurs.

The flue which connects to an upper, rear portion of the firebox draws the smoke and gases of combustion rearwardly in the firebox. The drafting from the front of the firebox where the vent is to the rear where the flue is located provides for a heater where a minimum amount of smoke and gases of combustion will pour through an open firebox door in the front of the heater.

In one specific embodiment a metal sheet is pivotally mounted inside the firebox above the firebox door. The metal sheet hangs downward partially blocking the firedoor to prevent smoke from escaping. The metal sheet pivots rearwardly to allow firewood and other fuels to easily be placed within the firebox.

In one specific embodiment, the top of the firebox is gable shaped. A draft vent is located in the top front portion of the firebox to allow air to enter the firebox therethrough and allow a drafting toward the flue of any stagnated smoke in the gabled top section of the firebox.

The firebox and hot flue heat the surrounding air outside the firebox but within the space of the casing.

The air enters through the intake and circulates around the firebox and flue. When heated, the air is exhausted through the hot air ducts and passes to the area to be heated. Preferably, the fan supplies the air into the casing, circulates the air around the firebox and flue, and forces the air into the hot air duct. Preferably, the fan is thermostatically controlled by a thermostat placed within the hot air duct. Preferably, the fan will be operated when the air within the air duct gets hotter than 130° F and will shut off when the air temperature drops below 100° F.

Preferably, a heat responsive switch is included in the solenoid's electrical circuit. The heat responsive switch is attached to the hot air so that if the air temperature within the duct gets too high, the heat responsive switch will shut off the current to the solenoid so that the vent flap door will close.

DETAILED DESCRIPTION OF THE PREFERRED EMBODIMENTS

Figure 1:
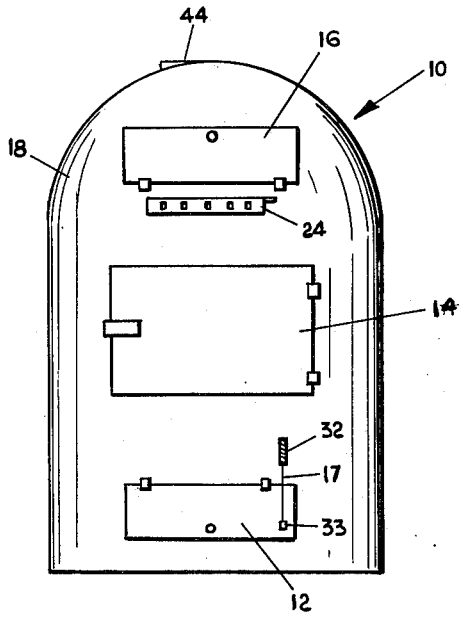
FIG. 1 is a front elevational view of a heater according to the invention.
Figure 2:
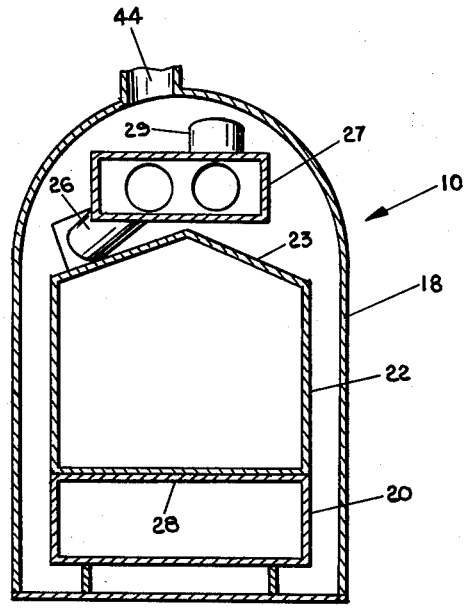
FIG. 2 is a partially broken front elevational view of the heater as illustrated in FIG. 1.

Referring now to FIG. 1, there are shown three doors 12, 14 and 16 mounted on a casing 18 of a heater 10. As shown in FIG. 2, door 12 provides an opening for access to an ash pit 20. Door 14 provides an access to the firebox 22. Door 16 provides an opening for access to a flue box 27.

The flue door 16 provides for an acces to the flue box 27 and flue pipes 26 and 29 so as to allow easy cleaning of the flue pipes and flue box.

The ash pit 20 is located below the firebox 22 toward the front portion thereof. A grate 28 is positioned between the ash pit and the firebox 22. The rear portion 30 of the firebox 22 is solid and comprises more than 50% of the firebox bottom surface. A flue pipe 26 is connected to the rear, top portion of the firebox 22 and extends forwardly to the flue box 27. A second flue pipe 29 extends from the flue box 27 to the rear of the heater and extends rearwardly therethrough. A duct 44 connects to an upper portion of the casing 18 providing a withdrawing means for withdrawing heated air from the heater 10.

The top portion 23 of the firebox 22 is gable shaped with its apex extending from the rear to the front of the firebox 22. At the front of the top portion 23 a draft vent 24 is mounted on the casing 18. The drafting vent has an open and close position. The drafting vent 24 has two adjacent slotted plates, one which is slidably mounted with respect to the other. In the open position, the first plate is positioned so its slots align with the slots of the second plate. In the closed position, the slots of the first plate are disaligned with respect to the slot of the second plate.

Figure 3:
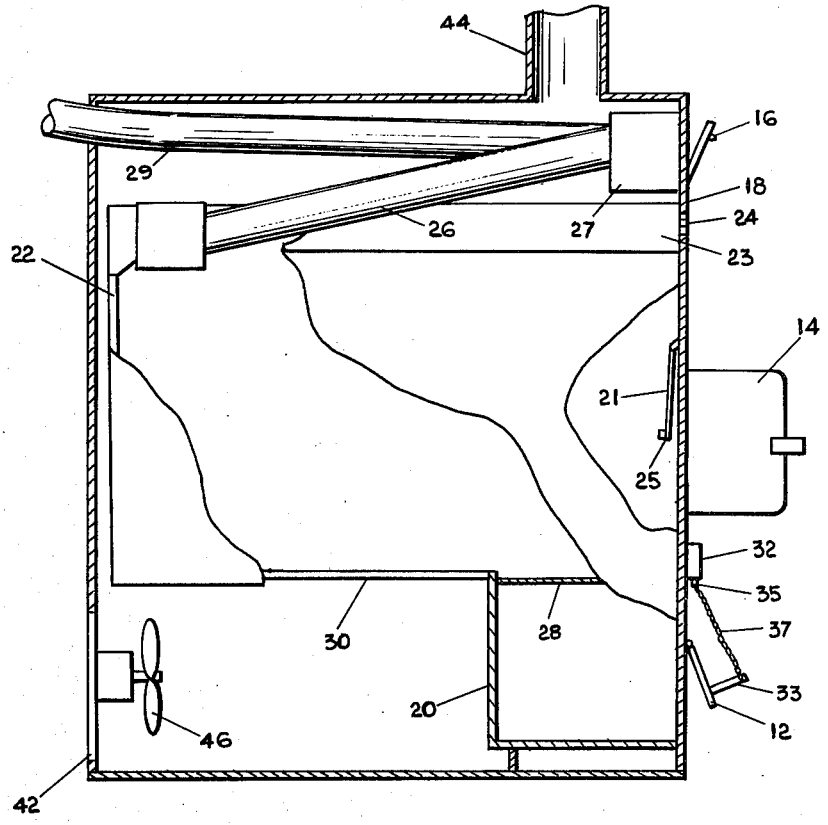
FIG. 3 is a broken side elevational view of the heater.

Referring to FIG. 3, within firebox 22 a metal sheet 21 is pivotally mounted above the firedoor 14. The sheet 21 hangs down partially blocking the entrance to the firebox 22. The sheet is weighted at its bottom edge 25 so that when the metal sheet is pivoted, it will return to a vertically hanging position.

The flap door 12 is hinged at the top and has a protusion 33 extending outwardly from its lower portion. A solenoid actuator 32 is connected to the exterior of the casing 10 above the vent flap door 12. This solenoid actuator 32 is preferably placed in a vertical position whereto a solenoid core 35 extends downwardly. A lightweight chain 37 is attached at one end to an outer end of the protrusion 33 and at the other end to the lower end of the solenoid core 35.

Figure 6:
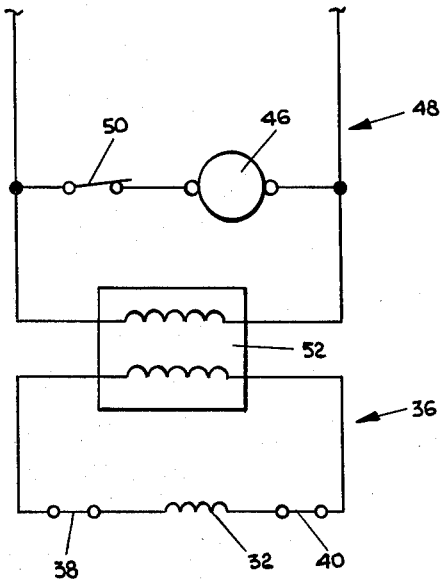
FIG. 6 is a schematic diagram of the electrical circuit which can be used in the heater according to the invention.
Figure 5:
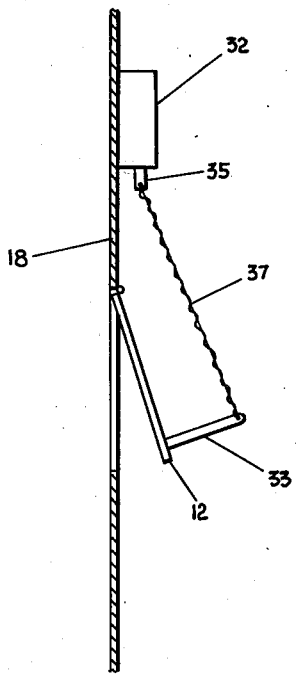
FIG. 5 is a fragmentary side elevational view of the solenoid actuator and vent flap in the open position.
Figure 4:
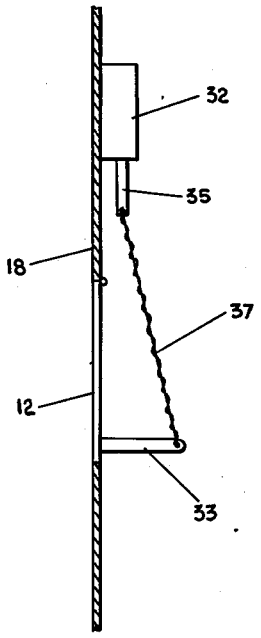
FIG. 4 is a fragmentary side elevational view of the solenoid actuator and vent flap in the closed position.

The solenoid actuator 32 is connected to an electrical circuit 36 as shown in FIG. 6. The circuit 36 is capable of energizing the solenoid coil so that the solenoid core 35 is pulled upwardly thus pulling against the chain 37 to open the vent flap door 12 as shown in FIG. 5. When the solenoid is not energized, as shown in FIG. 4, the solenoid core 35 extends downwardly so that the vent flap door 12 is closed. Electric circuit 36 has a thermostatic control switch 38 preferably placed remotely away from the heater and within the area to be heated. The thermostatic control switch 38, is open when a desired temperature of the room is obtained so that electrical current will not energize the solenoid and the flap door maintains a closed position. When the actual temperature of the space to be heated is below the desired temperature, the thermostat control switch 38 is closed and the flap door is in an open position.

A heat responsive switch 40 is included in the electrical circuit 36. The heat responsive switch 40 is located within the hot air duct 44 whereby when the air within the duct gets too hot, the heat responsive switch 40 is open. The electrical circuit 36 is opened and the solenoid is de-energized. Thus the flap door 12 attains a closed poition. The heat responsive switch 40 recloses when the air within the hot air duct cools down to a predetermined temperature.

The flap door 12, in conjunction with the solenoid actuator 32 and electric circuit 36, acts as an adjustable venting means which automatically lets in varied amounts of oxygen through the flap door 12 to produce a fire of a desired size.

An air intake 42 is located in the rear lower portion of the casing 18 below the firebox 22. A fan 46 is placed in the air intake 42.

As shown in FIG. 6, the fan 46 is connected to an electrical circuit 48 wherein a thermostatic fan control switch 50, located within the hot air duct 44, maintains a closed position when the temperature within the hot air duct 44 is over about 130° F and obtains an open or off position when the temperature within the hot air duct 44 is below about 100° F. After the fan comes on, it will thus continue to run until the temperature in the hot air duct falls below the predetermined minimum of 100° F. A voltage transformer 52 is placed between the electrical circuits 36 and 48 to provide current to circuit 36. These temperature ranges are adjustable and are given for purposes of illustration only.

The fan, when on, draws air through the intake 42 and circulates the air around the firebox 22, ash pit 20 and flue pipes 26 and 29 and flue box 27 and forces the heated air out through the hot air duct 44.

Venting of the air within the firebox 22 through the ash pit 20 which is located only under the front portion of the firebox 22 has two functions. Firstly, the air flow through the grate 28 and then next to and above the fire produces a slower, more efficient burning of the combustible material. Secondly, the direction of the venting of the air flow within the firebox is from the front to the rear portion to allow the firebox door 14 to be opened with a minimum amount of smoke and gases of combustion escaping through the firebox door opening.

Metal sheet 21 further minimizes smoke escaping from the top part of the firebox door opening while not impeding placement of firewood or other fuels within the firebox.

The draft vent 24 supplies air to the top portion 23 of the firebox 27. The air drafts any stagnated smoke to the flue 26. The venting of the top portion 23 further minimizes the presence of smoke which can escape through the firebox door 14.

The firebox 22 abuts the front interior of the casing 18. All other sides of the firebox are spaced from the casing 18. The ash pit 20 abuts the front interior of the casing 18 but is spaced from the casing 18 on all other of its surfaces. The flue pipes 26 and 29 are spaced from each other and spaced from the casing and firebox. The spacings between the firebox and casing, ash pit and casing, flue and firebox, and flue and casing provide for an efficient circulation of air around the heated furnace parts to provide for an efficient heat transfer between the furnace parts and the air to be heated within the casing.

It should be understood that the foregoing embodiments of the present invention are merely illustrative of the preferred practice of the present invention and that various changes and modifications may be made in the arrangements and details of construction of the embodiments described herein without departing from the spirit and scope of the present invention.

The embodiments of the invention in which an exclusive property or privilege is claimed are defined as follows:

1. A heating apparatus comprising:

a firebox having at least a partial nonporous bottom section on which combustible materials may be positioned, venting means in a front portion of the firebox for feeding combustion air into the front portion of the firebox;

a flue connected to the rear upper portion of the firebox for withdrawing gases of combustion from the firebox;

an ash pit located under the firebox and in communication with the firebox for receiving ashes from the firebox;

a casing enclosing the firebox and ash pit;

the flue extending to a front portion of the casing and back rearwardly to a rear portion of the casing where it exits therefrom;

a door means on a front portion of the casing for providing access to the interior of the flue;

a nonporous sheet pivotably mounted within the firebox above the door so that the sheet hangs in a vertical manner and partially blocks access to the front side of the firebox when in the vertical position;

intake means for supplying air into the casing to be heated;

withdrawing means for withdrawing heated air from the casing; and the casing being of sufficient size to permit passage of air from the intake means and to circulate around the firebox and flue and pass out through the withdrawing means.

2. A heating apparatus as descirbed in claim 1 wherein:

the ash pit is located only under the front portion of the firebox;

the front side of the ash pit abuts the interior of the front side of the casing;

the front side of the firebox abuts the interior of the front side of the casing;

the venting means includes a flap door on the front side of the casing for access to the ash pit and an open passage from the ash pit to the front, lower portion of the firebox; and a door positioned on the front side of the casing providing access to the front side of the firebox.

3. A heating apparatus as described in claim 2 further comprising the firebox having a gabled top portion and a venting means for venting gases of combustion from the top portion of the firebox to the flue.

4. A heating apparatus as described in claim 1 wherein an intake fan is operably positioned for supplying air through the intake means, for circulating the air throughout the casing, and forcing the air out through the withdrawing means.

5. A heating apparatus as described in claim 4 wherein:

the fan has a thermostatically set control switch means for operating the fan when the temperature within the withdrawing means but outside the firebox and flue is higher than a predetermined temperature and shuts off the fan when the temperature within the withdrawing means is below another predetermined temperature.

6. An apparatus as described in claim 1 wherein the venting means is adjustable between an open and shut position and an actuating means is operably connected to the venting means for opening and closing the venting means; the actuating means connects to an electrical potential wherein the actuating means is energized by an electrical current so as to open the venting means; thermostatic switch means is operably connected to the electric circuit for controlling the current through the actuating means.

7. An apparatus as described in claim 6 wherein the adjustable venting means includes a flap door mounted on the casing for movement between an open and closed position; the actuating means includes a solenoid actuator mounted on the casing above the flap door and operably connected thereto; the thermostatic switch means is mounted remotely from the casing in an area to be heated.

8. An apparatus as described in claim 7 wherein:

the front side of the ash pit abuts the interior of the front side of the casing;

the front side of the firebox abuts the interior of the front side of the casing;

the venting means includes a flap door on the casing for access to the ash pit and an open passage from the ash pit to the front, lower portion of the firebox;

a door positioned on the front side of the casing providing access to the front side of the firebox;

an intake fan is operably positioned for supplying air through the intake means, for circulating the air throughout the casing, and forcing the air out through the withdrawing means;

the fan has a thermostatically set control switch means for operating the fan when the temperature within the withdrawing means but outside the firebox and flue is higher than a predetermined temperature and shuts off the fan when the temperature within the withdrawing means is below another predetermined temperature;

the flue includes a flue pipe connected to the upper, rear portion of the firebox extending to a flue box adjacent the upper, front portion of the casing and a second flue pipe extending from the flue box to a rear, upper portion of the casing and passing therethrough; and a door on the front, upper portion of the casing provides access to the flue box and flue pipes.

* * * * *